United States Patent [19]

Miyamoto et al.

[11] Patent Number: 4,853,739

[45] Date of Patent: Aug. 1, 1989

[54] ILLUMINATING DEVICE FOR IMAGE EXPOSURE

[75] Inventors: Hirohisa Miyamoto; Yasuyuki Matsuuchi, both of Osaka, Japan

[73] Assignee: Minolta Camera Kabushiki Kaisha, Osaka, Japan

[21] Appl. No.: 210,758

[22] Filed: Jun. 23, 1988

[30] Foreign Application Priority Data

Jun. 25, 1987 [JP] Japan ..... 62-159270
Jun. 25, 1987 [JP] Japan ..... 62-159271

[51] Int. Cl.[4] ..... G03G 15/04
[52] U.S. Cl. ..... 355/229; 355/30
[58] Field of Search ..... 355/14 E, 14 R, 3 R, 355/30; 362/6

[56] References Cited

U.S. PATENT DOCUMENTS 3,330,180 7/1967 Ferguson et al. ..... 355/30 X
4,098,552 7/1978 Okukawa ..... 362/6 X
4,536,681 8/1985 Maki ..... 355/30 X

FOREIGN PATENT DOCUMENTS 54-48554 4/1979 Japan ..... 362/6
61-140933 6/1986 Japan .

*Primary Examiner*—R. L. Moses
*Attorney, Agent, or Firm*—Price, Gess & Ubell

[57] ABSTRACT

An illuminating device for image exposure in an electrophotographic copying machine, which employs a fluorescent lamp whose voltage is variable as an illumination source and has signals to indicate when the copying machine is ready to make copies and to tell when the light amount for illumination is insufficient after preliminary lighting being performed for a fixed amount of time. A temperature sensor to detect tube wall temperature of the fluorescent lamp and a light sensor to detect the amount of light emitted from the lamp installed in the device to permit the preliminary lighting of the fluorescent lamp to be carried out at an appropriate voltage. Therefore, clear copies are readily made soon after the power of the copying machine is turned on, and, electric power waste and/or serious troubles of the machine which may occur by further use as well as exhaustion of the lamp by unnecessary high voltages can be avoided.

11 Claims, 8 Drawing Sheets

ILLUMINATING DEVICE FOR IMAGE EXPOSURE

BACKGROUND OF THE INVENTION

1. Field of the Invention

This invention relates to an illuminating device for image exposure in an electrophotographic copying machine, an image reader and the like, which employs a fluorescent lamp whose voltage is variable as an illumination source and, more specifically, to an illuminating device which is capable of effectively starting up the illumination and of indicating an error status when the light amount for illumination is insufficient after preliminary lighting is performed for a fixed amount of time.

2. Description of the Prior Art

The amount of light emitted from a fluorescent lamp of an illuminating device in an electrophotographic copying machine fluctuates according to the tube wall temperature of the lamp. Thus, when copying is conducted under low room temperature, for example in winter, a conventional copying machine is slow in getting started because the tube wall which is initially equal to room temperature needs to be heated in order to obtain a desired amount of light for exposure. Illuminating devices of prior art, such as that disclosed in Japanese Laid-Open Patent Application No. 61-140933, attempt to overcome this disadvantage and to get ready to make copies in a shorter time period by increasing the tube wall temperature of the fluorescent lamp through heat which is generated by lighting the lamp at the maximum allowable voltage for a fixed amount of time immediately after the power is turned on.

However, the preliminary lighting is performed for a fixed amount of time which is irrespective of either initial tube wall temperature or desired light amount, and thus, the tube wall is not always heated to an appropriate temperature. Also, in case the tube wall temperature has not reached the appropriate temperature there is no way to know why; it may be due to low initial temperature of the tube wall, to exhaustion of the lamp, or to any other trouble of the copying machine. If the user keeps on using a copying machine with an illuminating device in the latter two cases, much serious troubles may be caused in the machine. Furthermore, the preliminary lighting at maximum allowable voltage reduces the life span of the fluorescent lamp.

SUMMARY OF THE INVENTION

An illuminating device for image exposure according to the present invention overcomes the disadvantage discussed above with the following features.

The main object of this invention is to provide an illuminating device for image exposure that readily copies clear images onto sheets of paper and of other materials soon after the power is turned on.

The second object of this invention is to provide an illuminating device for image exposure that extends the life span of the fluorescent lamp.

The above two objects are accomplished in the embodiments of the invention by detecting the tube wall temperature of the lamp and by controlling the lamp voltage in accordance with the tube wall temperature, that is, by supplying an appropriate amount of voltage to the lamp so that a desirable temperature for tube walls is reached as soon as possible.

The third object of this invention is to provide an illuminating device for image exposure that lets users know when a clear image copying is available and when the fluorescent lamp is no more good for use.

The fourth object of this invention is to provide an illuminating device for image exposure that avoids power wasting and other serious troubles of the copying machine triggered by exhaustion of the fluorescent lamp.

These two objects are accomplished with two indicators: one to indicate when clear copying is ready and another to indicate when the light amount from the lamp is insufficient after preliminary lighting being performed for a fixed amount of time. In the first embodiment the time is set to a preferred value by a timer which forms a part of the illuminating device, while in the second embodiment it is made equal to waiting time of an image fixing process.

BRIEF DESCRIPTION OF THE DRAWINGS

FIG. 2 is a cross-sectional view of the copying machine;

FIG. 3 is a cross-sectional view of the essential part of the copying machine in FIG. 2; and FIG. 4 is a plane view of an operation panel of the copying machine in FIG. 2.

FIG. 6 is a graphic illustration of lamp voltage and tube walls temperature control as a function of time;

FIG. 7 is a graphic illustration of the control as a function of time in FIG. 6 when light amount of a fluorescent lamp after preliminary lighting being performed for a fixed amount of time has not reached a desirable amount;

FIG. 8 is a flow chart of a main routine for the control;

FIG. 9 is a flow chart of a subroutine for the control; and

FIG. 10 is a graphic illustration of fixing heater control as a function of time when the light amount of a fluorescent lamp after preliminary lighting has been performed for a fixed amount of time has not reached a desirable amount in the second embodiment of the invention.

DETAILED DESCRIPTION OF THE INVENTION

An illuminating device for image exposure which employs a fluorescent lamp as an illumination source usually has means for changing lamp voltage to various values; the voltage may be changed by a switch, by changing the resistance of resistors, or by some other means. The device that incorporates the principles of the present invention differs from conventional ones in further having a temperature sensor to detect tube wall temperature of the fluorescent lamp and a light sensor to detect the amount of light emitted from the lamp.

These sensors are used as follows: as soon as the power of a copying machine is turned on the lamp is lighted preliminary at the voltage determined from the tube wall temperature which is detected by the temperature sensor, and, the voltage is decreased to end the preliminary lighting when the light sensor detects sufficient light from the lamp for exposure. After the preliminary lighting, a signal is indicated to tell that an image may now be copied clearly. In case sufficient light is not obtained and the lamp has to be lit preliminary longer than the fixed amount of time, a signal which informs that the light amount for image exposure is insufficient is output.

Such a mechanism leads to several attractive features of the invention. Since the tube wall temperature is known and the lamp voltage is varied according to the temperature which is proportional to the light amount, the desired amount of light is readily obtained after the power of the copying machine is turned on, and moreover, the lamp voltage is not increased to an unnecessary extent merely to exhaust the lamp.

Another advantage is that the ready-to-copy signal is output when sufficient light is obtained to start regular lighting, and thus, users can easily tell when the copying machine is ready to make clear copies.

Also, there is a signal to inform insufficiency of light amount. This signal is output when the desirable light amount is not reached at a maximum allowable voltage that would not shorten the life span of the lamp after a fixed amount of time. Therefore, the above signal indicates to the user that something is wrong with the lamp or the copying machine, and electric power waste and/or serious troubles of the machine which may occur by further use can be avoided.

Two embodiments are disclosed in this document and the common structures and features are described prior to those unique to each embodiment. Referring to the embodiments, it will be appreciated that the system described herein may be utilized with various photocopiers, such as those incorporated by reference herein.

Figure 2:
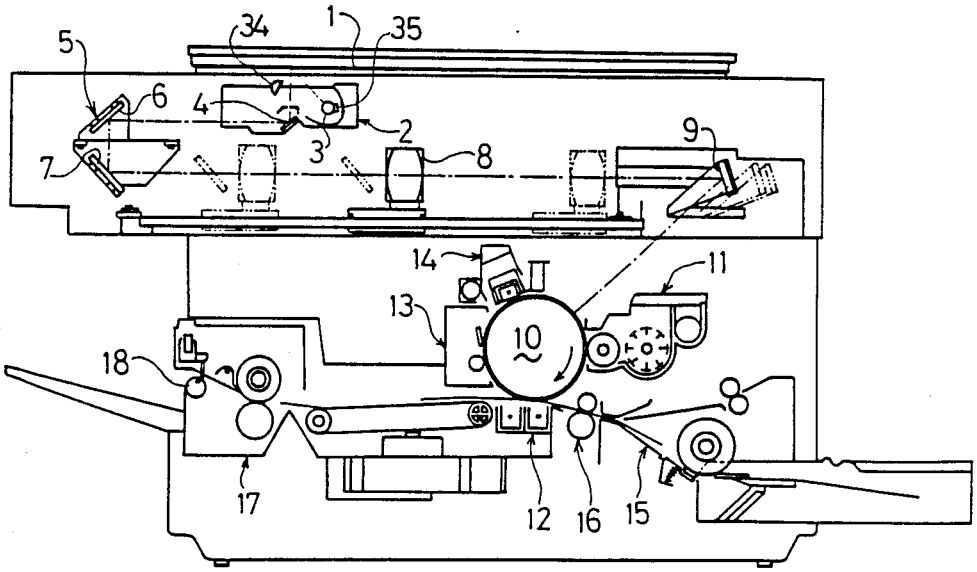
FIGS. 2 to 4 illustrate an electrophotographic copying machine in which an illuminating device for image exposure that incorporates the principles of the present invention may be installed.

In FIG. 2, numerals 1, 2, 3, 4, 5, 6, 7, 8, and 9 designate a document table which supports an original to be copied, a first moving table which is actually a scanner, a fluorescent lamp as an illumination source for image exposure, a first mirror, a second moving table, a second mirror, a third mirror, a lens, and a fourth mirror, respectively. The first moving table 2 has the fluorescent lamp 3 and the first mirror 4 fixed to it, while the second moving table 5 has the second and the third mirrors 6, 7 fixed to it.

The first moving table 2 performs scanning along the under surface of the document table 1, and the second moving table 5 moves half as much as the moved distance of the first moving table 2 to keep the optical path length constant. With this mechanism, an image of the original on the document table is exposed onto a photoconductive drum 10 through slits.

Around the photoconductive drum 10 are disposed a developing device 11, a transferring charger 12, a cleaner 13, and a charger 14. Numerals 15, 16, 17, and 18 designate a paper feeding section, a register roller, a fixing section, and a discharging roller, respectively.

Figure 3:
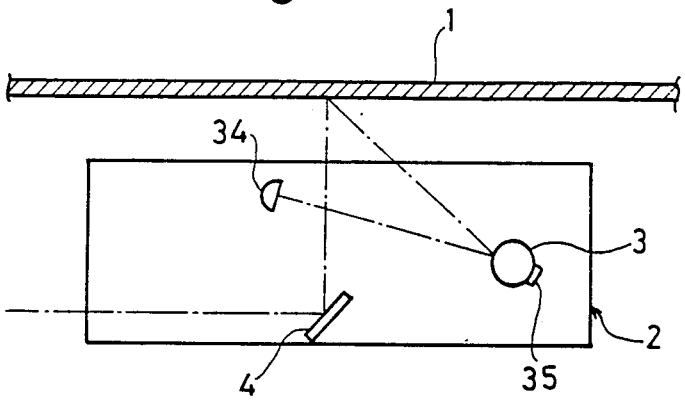

The first moving table 2 has a light sensor 34 and a temperature sensor 35: the light sensor 34 detects the amount of light emitted from the fluorescent lamp 3 where the distance between the sensor 34 and the lamp 3 is approximately the same with that between the original on the document table 1 and the lamp 3, as shown in FIG. 3; and the temperature sensor 35 detects the tube wall temperature of the lamp 3 directly and is attached to the lamp 3.

Figure 4:
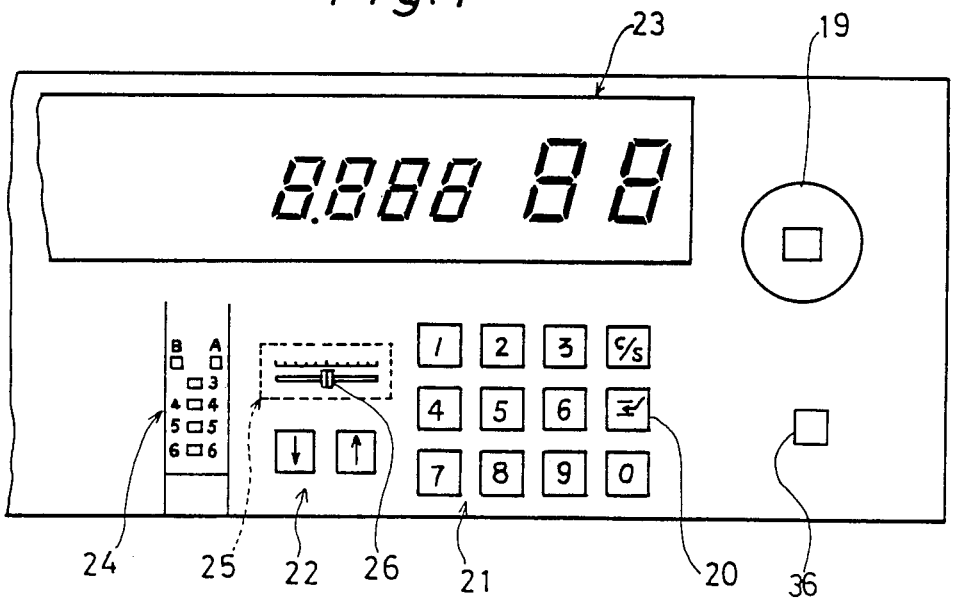

As shown in FIG. 4, the operation panel of a copying machine in which an illuminating device of this invention may be installed includes an indicator for ready-to-copy when able 19, which is also a key which makes copies when pressed, an interruption key 20, a key to set the number of copies to be made 21, a key to set projective magnification for copying 22, a numeral display 23, a paper selecting section to select papers of appropriate size 2, an adjuster to set an appropriate exposing degree 25, and an indicator to inform of any insufficiency in the light amount 36. The exposing degree adjuster 25 determines the densities of copied images by sliding a protrusion 26 along a slit which changes the amount of light to be emitted from the lamp 3. The copied image is lighter when the light amount is larger. The indicator for light amount insufficiency 36 gives a warning when the amount of light emitted from the fluorescent lamp 3 is less than necessary after a fixed amount of time.

Figure 1:
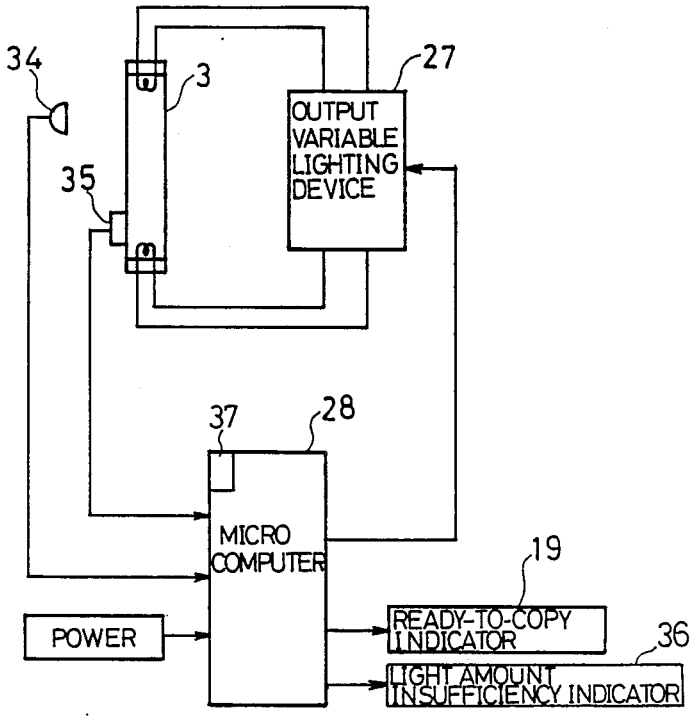
FIG. 1 is a block diagram of a fluorescent lamp control section of an exemplary illuminating device for image exposure employing the principles of the present invention in an electrophotographic coping machine.
Figure 5:
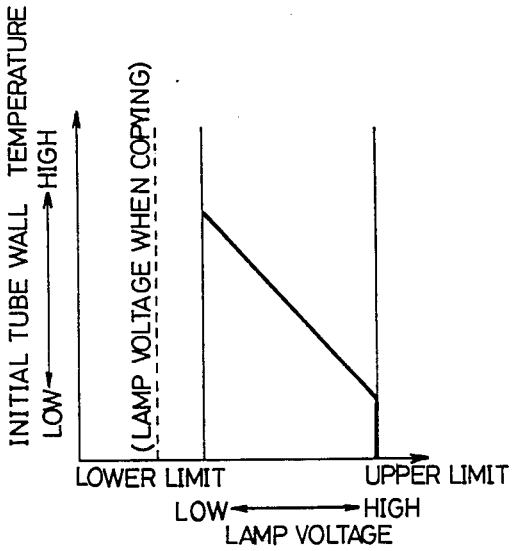
FIG. 5 is a graphic illustration of the relationship between lamp voltage and tube wall temperature.

The fluorescent lamp 3 is connected to a lighting device of variable output type 27, as shown in FIG. 1. The lighting device 27 has a lighting signal and a voltage level signal input when the power is turned on in order to light the lamp 3 preliminary at a high level of voltage which is varied according to the initial tube wall temperature of the lamp 3, as shown in FIG. 5; high voltage is given to the lamp if the initial tube wall temperature is low and low voltage if the temperature is high.

However, in case the initial tube wall temperature is sufficiently high to emit a desirable amount of light preliminary lighting is not necessary, and thus, it is suggested to set the lower limit of lamp voltage for preliminary lighting higher than the lowest possible voltage for making copies. In case the tube wall temperature is extremely lower than that required for copying that preliminary lighting has to be conducted at too high a voltage to cause lamp exhaustion, the lamp load is relieved by setting an upper limit of preliminary lighting voltage although longer preliminary lighting may be required.

The prementioned lighting signals and voltage level signals are input to the lighting device of a variable output type 27 by a microcomputer 28 which is input light amount data of the fluorescent lamp 3 detected by the light sensor 34 and tube wall temperature data of the lamp 3 detected by the temperature sensor 35.

The two embodiments disclosed in this document incorporate the principles of the same invention but differ from each other in the maximum length of preliminary lighting; the first embodiment has a timer to set the time at a preferred value while the second makes the time equal to the waiting time for an image to be fixed at a fixing section 17. In other words, further mechanism of an illuminating device of this invention is different in each embodiment. Both of the embodiments are described below in order.

The microcomputer 28 of the first embodiment starts a timer 37 coincidentally with the output of a lighting signal which orders to light the lamp 3. If the amount of light emitted from the fluorescent lamp 3 is less than that required for copying after the time set by the timer is up, the microcomputer 28 cancels the lighting signal and outputs a light amount insufficiency signal to light the indicator for light amount insufficiency 36. It should be noted that the timer is set to be up only after the waiting time at the fixing section 17 is up.

Figure 6:
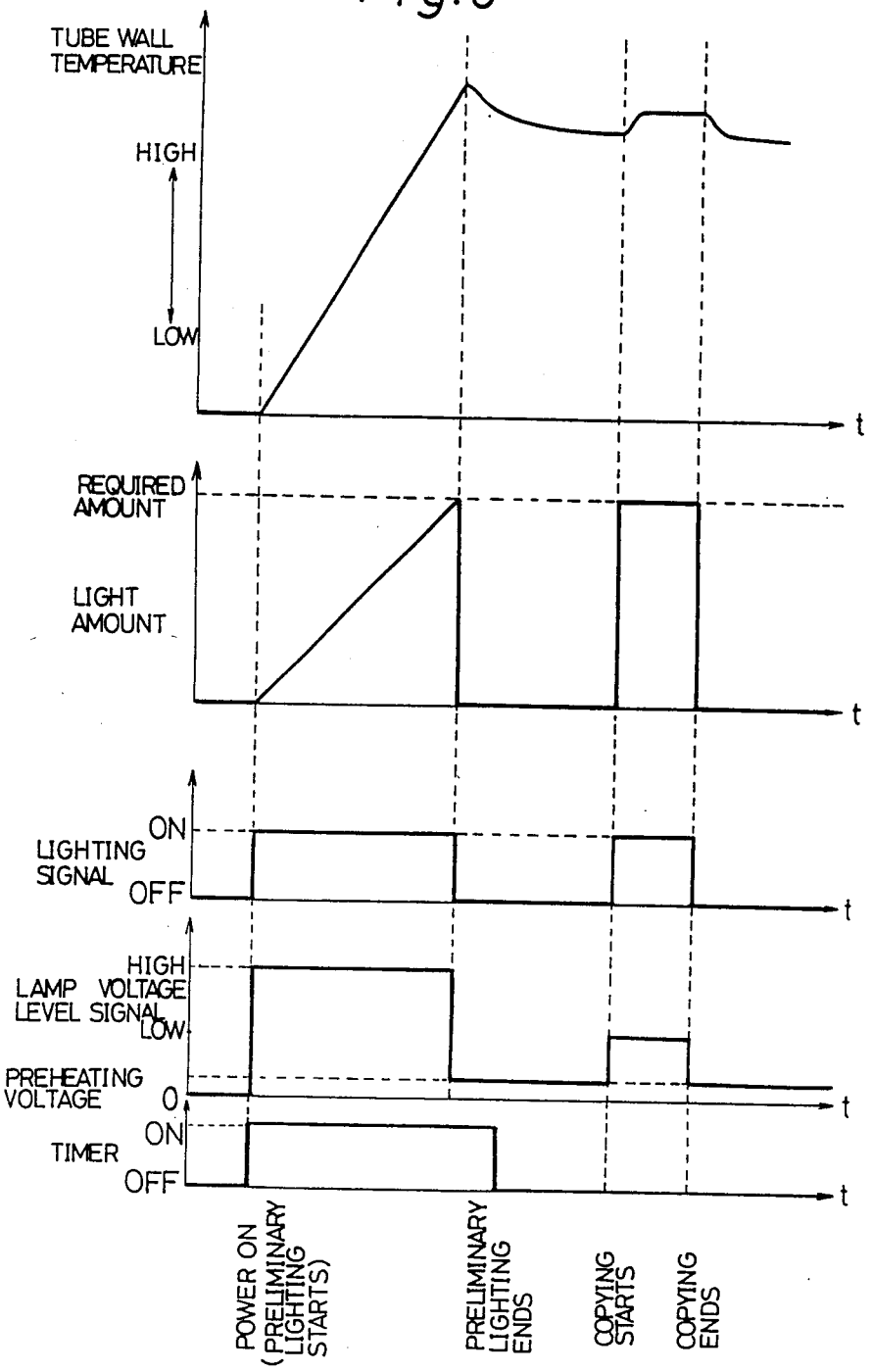
FIGS. 6 to 9 illustrate control of light emitted from a fluorescent lamp of the first embodiment and FIG. 10 illustrates that of the second embodiment.

Referring to FIG. 6, changes with time in initial tube wall temperature, light amount, lighting signal, voltage level signal, and timer is described below. When the power is turned on, the lighting signal is succeedingly output and the timer 37 starts timing at the same time.

During preliminary lighting, high voltage whose value is determined by the initial tube wall temperature of the fluorescent lamp 3 detected by the temperature sensor 35 is given to the lamp 3. The correspondence between the initial tube wall temperature and the lamp voltage is as shown in FIG. 5. The tube wall temperature is increased through self heat generation approximately in proportion to the length of the preliminary lighting, and in turn the amount of emitted light is increased. The light amount is detected by the light sensor 34 to be input to the microcomputer 28. The microcomputer 28, then, checks if the light amount is over the required. If not, the preliminary lighting is continued within the operating time of the timer 37.

When the light amount becomes equal to or more than the require amount, the preliminary lighting is put to an end and the lighting signal is canceled. At the same time, the lamp voltage is changed to a preheating level at which the lamp can maintain the required amount of emission and a ready-to-copy signal is output to light the indicator 19.

The tube wall temperature of the fluorescent lamp 3 somewhat decreases after preliminary lighting due to heat radiation, but soon becomes approximately constant by supplying preheating level voltage. That is, since the amount of light emitted from the fluorescent lamp 3 is maintained constant after the ready-to-copy indicator 19 is lit, users can rely on the copying machine for clear copying when the indicator tells it is ready to make copies. In detail, when the ready-to-copy indicator 19 which is also a key is depressed, a voltage level signal whose level is determined by the exposing degree adjuster 25 as a well as a lighting signal are output.

Figure 7:
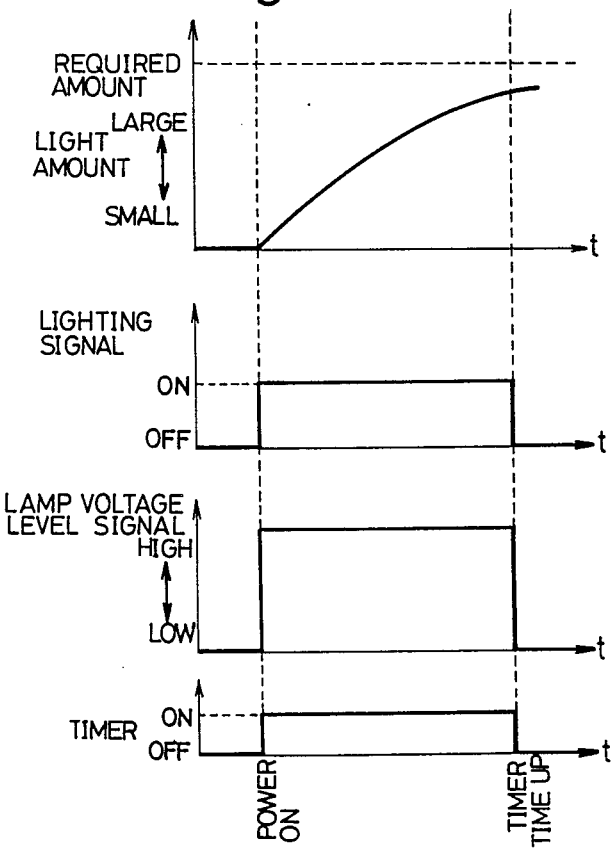

However, if the fluorescent lamp 3 is worn out and/or if there are some other problems in the copying machine, the light sensor 34, as shown in FIG. 7, detects insufficiency of the light amount when the time set by the timer 37 is up to stop preliminary lighting and lights the indicator 36 to inform the user of the insufficiency.

Figure 8:
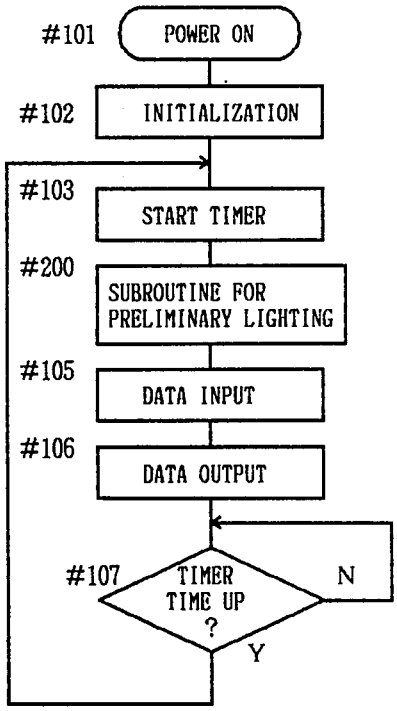

The flow of incidents after the power is turned on, which is described above, is now explained according to the flow chart in FIG. 8.

When the power is turned on step #101), RAM of the microcomputer 28 is cleared, various resistors are initialized, and the copying condition is set to the standard one (step #102). At the next step (#103) the timer starts timing and preliminary lighting is conducted as a subroutine (step #200). Then, the data from the light sensor 34 and the tube wall temperature sensor 35 are input (step #105) and output (step #106) to and from the microcomputer 28. When the time set by the timer is up, the main routine is over and step #103 is conducted again.

Figure 9:
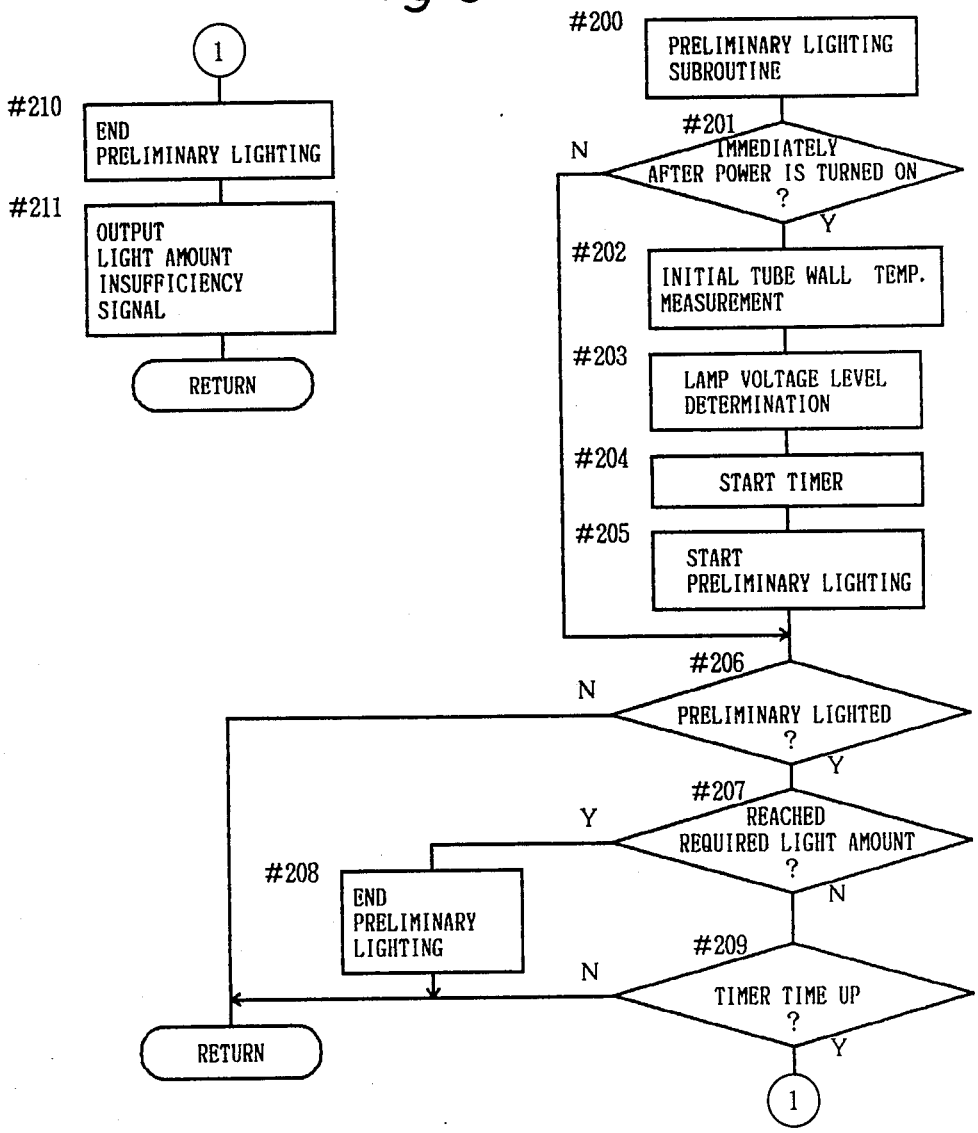

The preliminary lighting at step #200 is a subroutine and is described in detail referring to FIG. 9. First, it is checked whether the power has been turned on shortly before (step #201). If not, step #206 is conducted. If so, step #202 is conducted. At step #202, the initial tube wall temperature is measured so that the lamp voltage during preliminary lighting is set according to the temperature. In this step #202, the lamp voltage to be set is regulated by the upper limit voltage so as not to increase to an unnecessary extent resulting in an exhaustion of the lamp. Then, the timer 37 which has its maximum length set according to the above lamp voltage starts timing (step #204), and also, preliminary lighting is started (step #205).

Step #206 checks whether the preliminary lighting is still continued. If not, the routine returns to the main routine If so, step #207 is conducted to check whether the light amount has reached its required value. If reached, the preliminary lighting is ended (step #208) and the routine returns to the main routine. If not reached, it is checked whether the time set by the timer 37 is up (step #209). In case the time is not up, the routine is conducted again to continue the preliminary lighting. If the time is up, the preliminary lighting is ended (step #210) to output a light insufficiency signal so that the indicator which informs of the insufficiency is lit (step #211).

Figure 10:
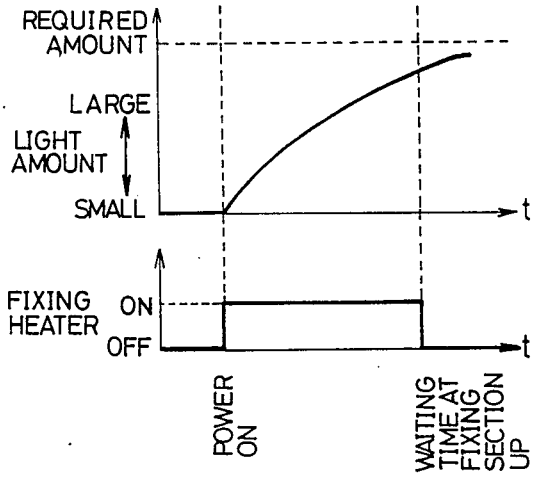

The second embodiment of the present invention performs preliminary lighting as long as the waiting time at the fixing section, as shown in FIG. 10, instead of performing as long as the time set by a timer, as is, as the case in the first embodiment.

In addition to the above, there are some functions in the first embodiment that can be replaced: the fluorescent lamp can be heated prior to regular lighting by a heater instead of using heat of self generation; and the tube wall temperature of the lamp can be detected indirectly instead of attaching a temperature detector to the fluorescent lamp and detecting directly. Also, since a copying machine is not necessarily out of order immediately after light insufficiency is informed by an indicator, it would be convenient if the operation mode can be made manual so that the users may make copies in case they need them urgently.

While the present invention has been described in connection with certain specific embodiments, it is to be understood that it is not to be limited to those embodiments. On the contrary, it is intended to cover all alternatives and modifications falling within the spirit and scope of invention as set forth in the appended claims.

What is claimed is:

1. An illuminating device for image exposure, which uses a fluorescent lamp whose voltage is variable as an illumination source, the illuminating device comprising:

means for detecting the temperature of the lamp tube wall;

means for detecting the amount of light emitted from the lamp;

means for lighting the lamp prior to copying at a higher voltage than that required for making copies, the higher voltage is determined in accordance with the initial temperature of the lamp tube wall detected by the temperature detecting means; and means for terminating the preliminary lighting the detected light amount is equal to or larger than the required amount.

2. An illuminating device as claimed in claim 1 further comprising:

means for setting a maximum time period for the preliminary lighting; and means for indicating any insufficient condition of a light amount when the detected light amount did not reach that amount of light required for copying after the time period expired.

3. An illuminating device as claimed in claim 2, further comprising:

means for setting an upper limit of lamp voltage for preliminary lighting.

4. An illuminating device as claimed in claim 2, wherein said means for setting a maximum time period includes a timer to generate a signal when the maximum time period is expired.

5. An illuminating device as claimed in claim 2, wherein said means for setting a maximum time period includes means for receiving a signal from a fixing section when the fixing section reaches a predetermined temperature for fusing.

6. In an electrophotographic copying machine having an illumination source that is sensitive to ambient temperature in producing illumination of an original, the improvement comprising:

means for detecting the temperature of the illumination source prior to its initial energization and producing a corresponding signal, and means for setting a voltage level of initial energization of the illumination source in response to the temperature signal.

7. The copying machine of claim 6 further including means for indicating to the user that the illumination source is operative for copying.

8. The copying machine of claim 6 further including means for indicating to the user that the illumination source is inoperative for copying.

9. The copying machine of claim 6 further including a timer for setting a predetermined time period, means for sensing the output of illumination and means for indicating to the user that the illumination source is inoperative for copying if the sensed light has not reached a predetermined level.

10. The copying machine of claim 9 further including means for setting an upper and lower voltage limit within the predetermined time period.

11. In an electrophotographic machine having an illumination source that is sensitive to temperature in producing illumination of an original, the improvement comprising:

means for detecting the temperature of the illumination source prior to its initial energization and producing a corresponding temperature signal;

means for setting a power level for initial energization of the illumination source in response to predetermined power levels and in response to the temperature signal;

means for measuring the illumination output and producing a corresponding light signal, and means for indicating the operativeness of the illumination source to the user in response to the corresponding light source within a predetermined time period.

* * * * *